US005398705A

United States Patent [19]

Hiltbrand et al.

[11] Patent Number: 5,398,705

[45] Date of Patent: Mar. 21, 1995

[54] METHOD AND APPARATUS FOR FORMING HAIR BOWS

[76] Inventors: Gregory R. Hiltbrand; Deena J. Hiltbrand, both of 12903 Forest Dale, Omaha, Nebr. 68123

[21] Appl. No.: 149,636

[22] Filed: Nov. 9, 1993

[51] Int. Cl.[6] ..... A45D 8/12

[52] U.S. Cl. ..... 132/275; 132/279; 132/273; D28/42

[58] Field of Search ..... 132/273, 274, 275, 276, 132/277, 278, 279, 280, 281, 282, 283, 284; D28/39, 40, 41, 42, 43

[56] References Cited

U.S. PATENT DOCUMENTS

| | | | |
|---|---|---|---|
| 39,554 | 9/1908 | Farrell . | |
| 119,846 | 4/1940 | Kayn . | |
| 279,931 | 7/1985 | Nemoto | D28/93 |
| 492,561 | 2/1893 | Seidell . | |
| 926,450 | 6/1909 | Yeomans . | |
| 956,991 | 5/1910 | Nathanson | 132/279 |
| 1,007,586 | 10/1911 | Martin | 132/275 |
| 1,055,428 | 3/1913 | Stone . | |
| 1,221,172 | 4/1917 | Hamilton . | |
| 1,255,348 | 2/1918 | Stone | 132/275 |
| 1,470,631 | 10/1923 | Marion | 132/275 |
| 1,480,935 | 1/1924 | Gleason | 132/278 |
| 2,169,596 | 8/1939 | Solomon | 132/275 |
| 4,991,607 | 2/1991 | Chen | 132/278 |
| 5,062,436 | 11/1991 | Emesellem | 132/275 |

FOREIGN PATENT DOCUMENTS

| | | | |
|---|---|---|---|
| 399681 | 6/1909 | France | 132/275 |
| 472857 | 12/1914 | France | 132/279 |
| 559126 | 9/1923 | France | 132/275 |
| 570207 | 4/1924 | France | 132/275 |
| 487810 | 12/1929 | Germany | 132/275 |

*Primary Examiner*—John G. Weiss
*Attorney, Agent, or Firm*—John A. Beehner

[57] ABSTRACT

A method and apparatus for forming decorative hair bows includes the steps of providing an apparatus including a longitudinally extended hair bow frame having top and bottom surfaces and a barrette clip mounted on the bottom surface of the frame, the frame including a plurality of openings extending between the top and bottom surfaces. The method further includes providing an elongated strip of decorative material and extending a portion of the strip of decorative material through one of the openings in the frame such that a loop of decorative material is formed extending out of an opening above the top surface of the frame. This step is then repeated using different openings and different portions of the strip of decorative material until a plurality of upwardly extending loops of the decorative material are formed extending from a plurality of openings on the frame of the apparatus thus forming a decorative hair bow.

11 Claims, 7 Drawing Sheets

METHOD AND APPARATUS FOR FORMING HAIR BOWS

BACKGROUND OF THE INVENTION

1. Technical Field

This invention relates to methods and apparati for making hair bows, and, more particularly, to a method for forming hair bows which includes providing an apparatus including hair bow frame and a barrette clip, the frame having a plurality of openings therein each adapted to accept and hold a portion of an elongated strip of fabric thus forming a plurality of loops which create a hair bow.

2. Description of the Prior Art

The use of hair ornaments to accessorize outfits has been known since the first person placed a flower in their hair to appear more attractive. As time went on, however, the number and type of hair accessories available to accessorize outfits has increased dramatically. This increase can be directly related to the increase in the number of styles and fabrics used to make outfits. The situation has progressed to the point that an ordinary woman may have over 20 different outfits for work and/or recreation. To provide an equal number of hair accessories (i.e., one for each outfit) is simply not feasible for most women. Therefore, there is a need for a hair accessory which may be modified for coordination with a variety of outfits.

Several prior art inventions disclose hair accessories which are ribbon holders. Included among these are Stone, U.S. Pat. No. 1,055,428, Hamilton, U.S. Pat. No. 1,221,172 and Yeomans, U.S. Pat. No. 926,450. All of these devices, however, are severely limited in the type of hair accessory which may be produced in utilizing the devices. For example, in Hamilton, the hair accessory may only produce a bow-shaped ribbon, and may not produce any other hair accessory. Furthermore, care must be taken with each of the above-identified devices in inserting and removing the ribbon from the device, lest tearing or rending of the ribbon take place. Therefore, there is a need for a hair accessory device which may produce a variety of designs and which may be quickly and easily adjusted from one type of design to another without destruction of the fabric held thereby.

Another disadvantage of the prior art is that only relatively stiff materials such as wire-reinforced ribbon may be used in the devices to achieve the desired design for the accessory. Use of a scarf, bandanna or other such colored fabric results in a hair accessory which does not achieve a pleasing appearance.

Therefore, an object of the present invention is to provide an improved method and apparatus for forming hair bows.

Another object of the present invention is to provide a method for forming hair bows which includes providing a hair bow frame having a longitudinally extended plate having a plurality of openings therein, the plate being connected to a hair securement device for securement to hair.

Another object of the present invention is to provide a method for forming hair bows which includes providing an elongated strip of decorative material and extending portions of that decorative material through the openings in the plate to form a plurality of loops of fabric which together form a decorative hair accessory.

Another object of the present invention is to provide a method for forming hair bows which may be used with almost any fabric or material, including scarves, bandannas or colored swatches of fabric.

Another object of the present invention is to provide a method and apparatus for forming hair bows which will produce various sizes and various shapes of bows while utilizing the same hair bow frame.

Another object of the present invention is to provide an apparatus for forming hair bows which includes a longitudinally extended resilient plate and a barrette clip removably mounted on the underside of the plate, the plate further including a plurality of openings, and the apparatus further including a mounting device for detachably mounting the barrette clip to the plate.

Finally, an object of the present invention is to provide a method for manufacturing hair bows which is relatively simple and inexpensive to use and which produces hair bows in a variety of shapes and sizes.

SUMMARY OF THE INVENTION

The present invention provides a method and apparatus for forming a decorative hair bow. The method includes the steps of providing a hair bow frame having top and bottom surfaces and a barrette clip mounted on the bottom surface of the frame, the frame including a plurality of openings extending between the top and bottom surfaces. An elongated strip of decorative material having opposite ends is also provided. A portion of the strip of decorative material is extended through one of the openings in the frame, the portion of the strip then folded back onto itself and extended back through the opening through which the portion was first extended thereby forming a loop of decorative material extending out of one of the openings above the top surface of the frame. The extending, folding and forming steps are then repeated using another portion of the strip and another one of the openings until a plurality of upwardly extending loops of decorative material are formed extending from a plurality of openings.

The apparatus of the present invention consist of a hair bow frame having top and bottom surfaces. The apparatus also includes a barrette clip which is removably mounted on the bottom surface of the frame. The hair bow frame further includes a plurality of openings extending between the top and bottom surfaces of the frame. Finally, the apparatus includes a device for detachably fastening the barrette clip to the bottom surface of the hair bow frame so that the barrette clip may be detached from the hair bow frame to avoid interference with training a strip of decorative material through the openings.

It can thus been seen that the present invention provides a substantial improvement over those hair accessories found in the prior art. The openings in the hair bow frame allow for a wide variety of decorative materials to be used for making coordinating hair fashions, materials such as scarves, ribbons, or other such elongated strips of fabric. Furthermore, as the barrette clip is detachable from the hair bow frame, formation of various hair bow designs is greatly facilitated. The present invention thus provides a substantial improvement over those devices found in the prior art.

DESCRIPTION OF THE PREFERRED EMBODIMENT

The apparatus of the present invention includes a hair bow frame 10 which includes a longitudinally extended generally resilient plate 12 and a barrette clip 14. The plate 12 is preferably constructed of a resilient plastic or polyurethane or a wire frame and may be either resilient or rigid, depending upon the intended use of the apparatus, and is preferably constructed having a slight concave curve, as shown in FIGS. 1–4B. It is also preferred that the plate 12 be generally oval in shape, although this is not critical or necessary to the invention.

Figure 2:
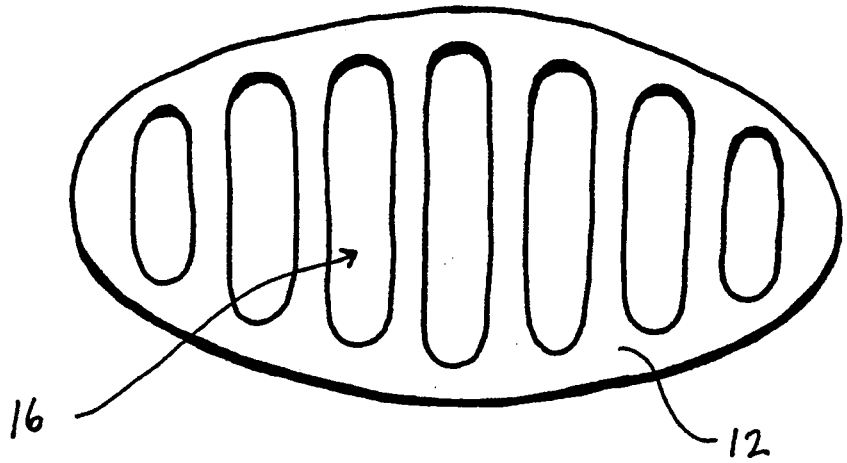
FIG. 2 is a perspective view of the hair bow frame including the longitudinally extended plate and the barrette clip.
Figure 3:
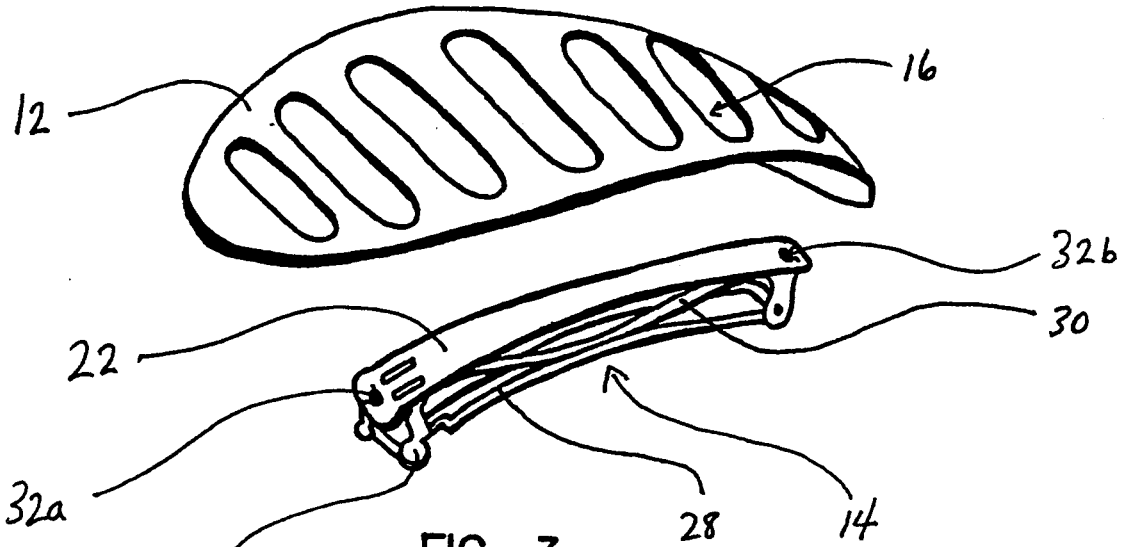
FIG. 3 is a top plan view of the plate of the present invention.
Figure 4:
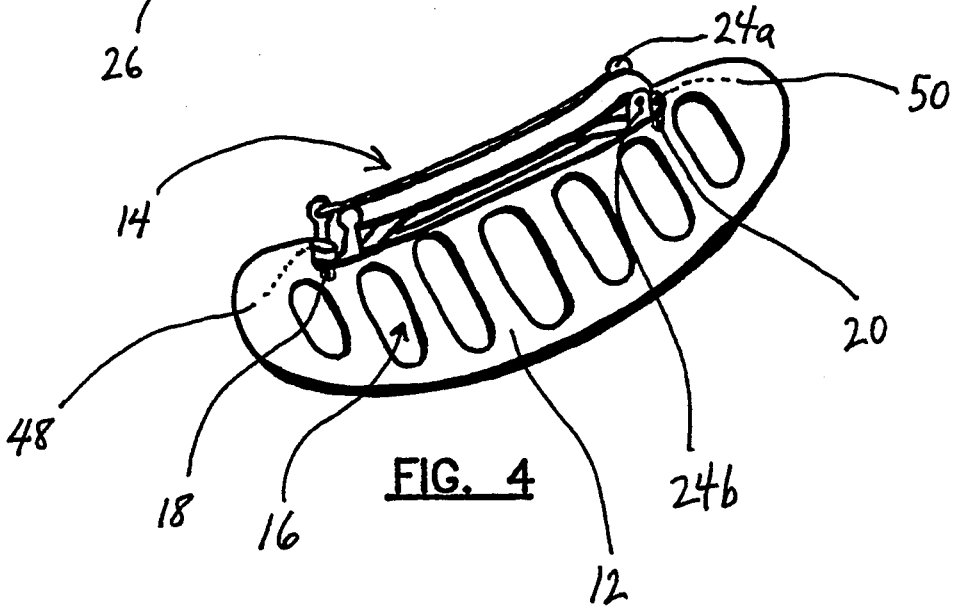
FIG. 4 is a perspective view of the underside of the hair bow frame clearly showing the barrette clip.

The plate 12 further includes a plurality of longitudinally spaced transverse openings 16, shown most clearly in FIGS. 2–4. These transverse openings 16 may vary in size and shape, however, it is preferred that the transverse openings 16 be elongated slots as shown in FIGS. 2–4.

Preferably integrally formed on the underside of the plate 12 are a pair of barrette clip attachment posts 18 and 20 which extend downwards from the bottom side of the plate 12 and are adapted to receive and secure the barrette clip 14.

The barrette clip 14 is preferably a standard-type barrette clip 14 which includes a concave base bar 22 which includes downwardly extending pivot posts 24*a* and 24*b* spring clip 26. Pivotally mounted between the pivot posts 24*a* and 24*b* is a securement bar 28 which is secured in generally parallel alignment to the base bar 22 by spring clip 26. The barrette clip 14 finally includes a spring bar 30 which is movably mounted to the base bar 22 and is generally convex in shape, the spring bar 30 providing tensioning force to secure the securement bar 28 on spring clip 26.

It is preferred that the barrette clip 14 be constructed of metal or a hard plastic for durability. Furthermore, it is to be understood that a variety of types of barrettes may be used with the plate 12 of the present invention, of which the described barrette is only an example of a standard barrette model.

It is further to be understood that a variety of hair securement devices may be used with the present invention in place of the previously described barrette clip 14. For example, the plate 12 of the present invention may be secured to hair by a China stick, which is typically an elongated wooden stick having a tapered end and a flat end, the China stick being inserted into an end opening of the plate 12, extending across the bottom surface of the plate 12 and extending through the end opening on the opposite side, thus securing a section of hair between the China stick and the plate 12. It is further contemplated that the plate 12 of the present invention be connected to other hair securement devices, such as hair combs and/or banana clips, yet still retain those features allowing for formation of various kinds of hair bows. As such hair securement devices are well known to those skilled in the art, it is believed that there is no need to display such devices.

It is preferred that the base bar 22 of the barrette clip 14 include a pair of holes 32*a* and 32*b* adjacent opposite longitudinal ends of the base bar 22. The holes 32*a* and 32*b* are preferably formed in the base bar 22 such that when opposite ends of the longitudinally extended plate 12 are flexed upwards, thus decreasing the curvature of the plate 12 and increasing the distance between the left and right attachment posts 18 and 20, the holes 32*a* and 32*b* are substantially aligned each with one of the left and right attachment posts 18 and 20. The posts 18 and 20 then extend into and through the holes 32*a* and 32*b*, and when the plate 12 is allowed to resume its original generally concave shape, the posts 18 and 20 and holes 32*a* and 32*b* cooperate to secure the barrette clip 14 to the longitudinally extended plate 12.

Figure 4A:
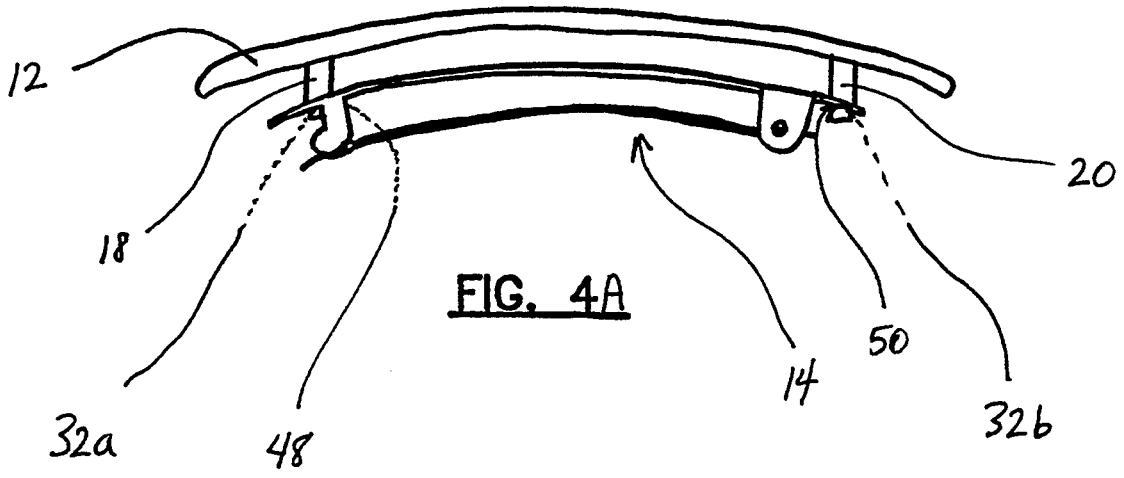
FIG. 4*a* is a side elevational view of the hair bow frame and barrette clip showing the attachment post and the curvature of the hair bow frame.
Figure 4B:
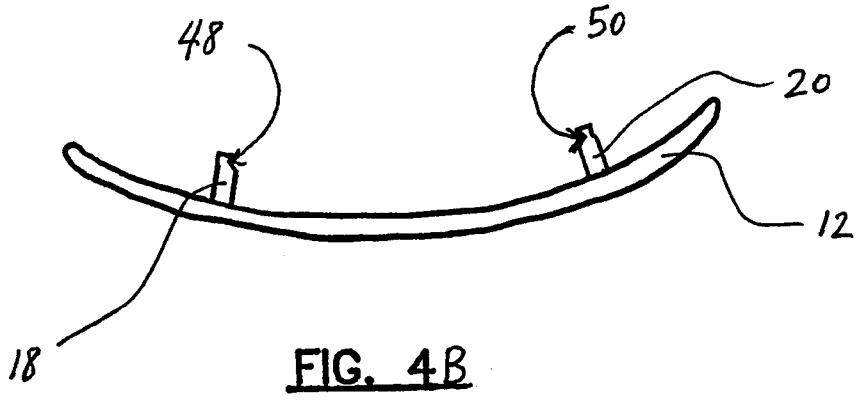
FIG. 4*b* is a side elevational view of the plate by itself showing the notches on the attachment post for securing the barrette clip to the plate.

To further secure the barrette clip 14 on the posts 18 and 20, posts 18 and 20 include generally horizontal notches 48 and 50 formed in the top portion of each post 18 and 20. These notches 48 and 50 engage the sides of respective holes 32*a* and 32*b*, thus restricting movement of the barrette clip 14 towards or away from the resilient plate 12. FIGS. 4*a* and 4*b* best show the attachment post 18 and 20 and notches 48 and 50 of the present invention. FIG. 4*a* shows how the notches 48 and 50 accommodate the sides of the holes 32*a* and 32*b* thus securing the barrette clip 14 to the resilient plate 12. FIG. 4*b* more clearly shows the notches 48 and 50.

Of course, it is to be understood that the barrette clip 14 may be permanently attached to the plate 12, however, it is preferred that the barrette clip 14 be removable from the plate 12 to simplify the method of forming the hair bow, to be described hereafter as the barrette clip 14 may impede the looping of fabric through the transverse openings 16 in the plate 12.

Figure 1:
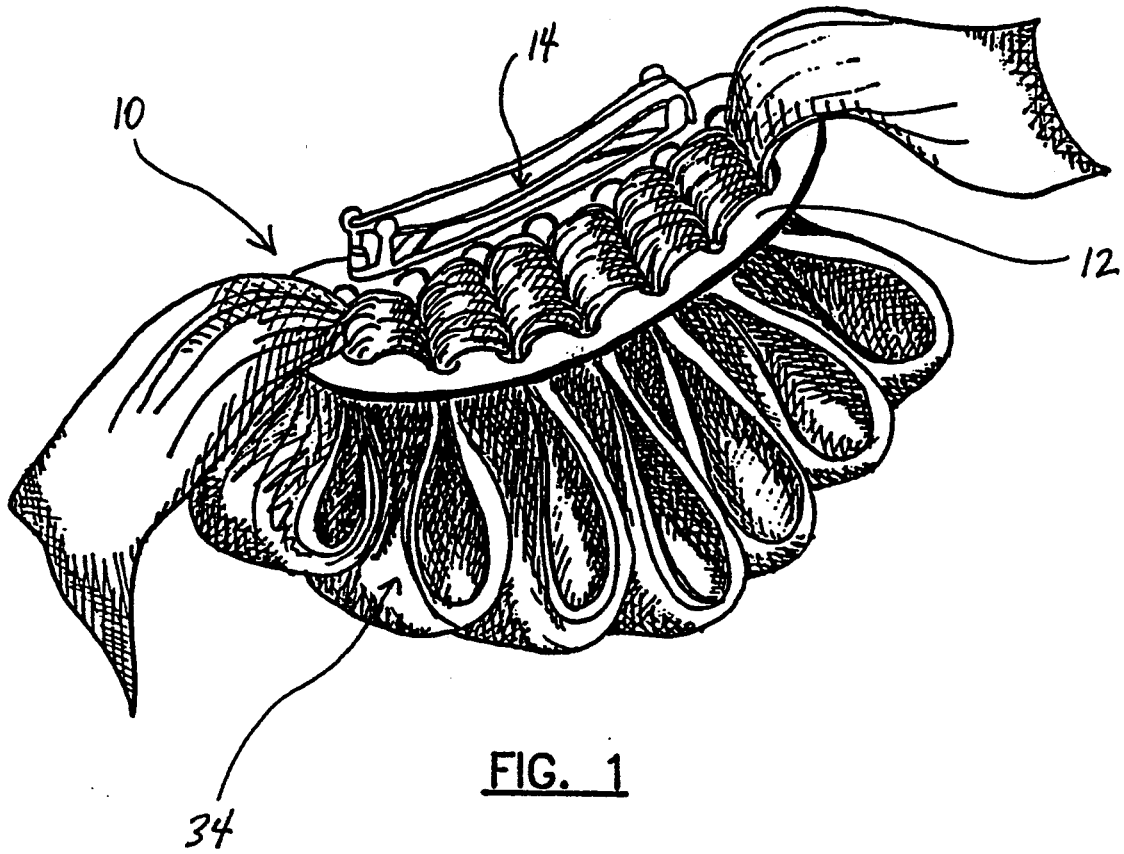
FIG. 1 is a perspective view of a finished bow of the invention.
Figure 5:
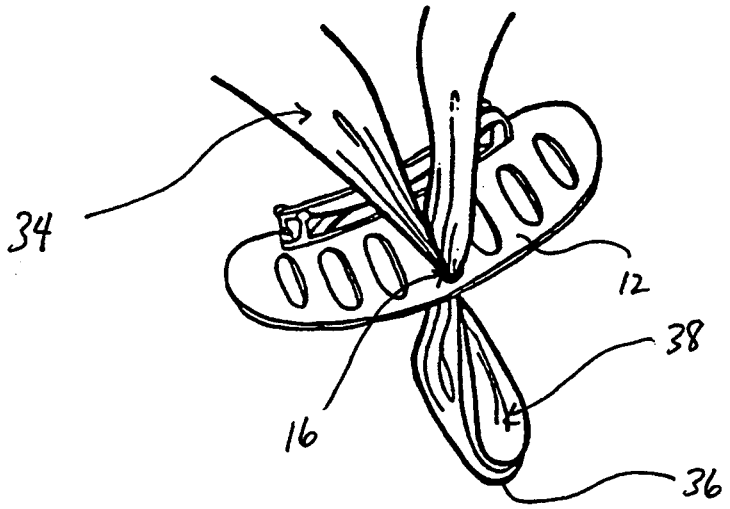
FIG. 5 is a bottom perspective view of the frame having a first loop of fabric passed through one of the openings.
Figure 6:
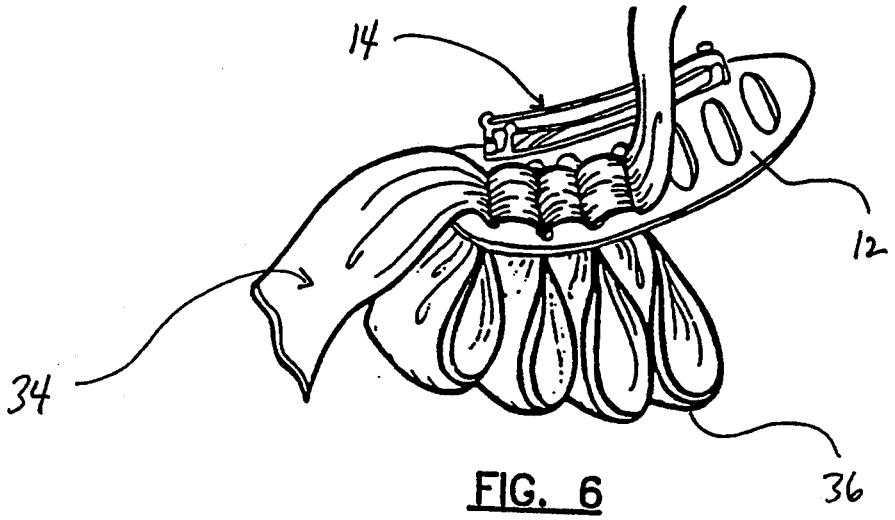
FIG. 6 is a bottom perspective view of the frame and strip of fabric, the fabric extending through several of the openings on the frame thus forming a plurality of loops.
Figure 7:
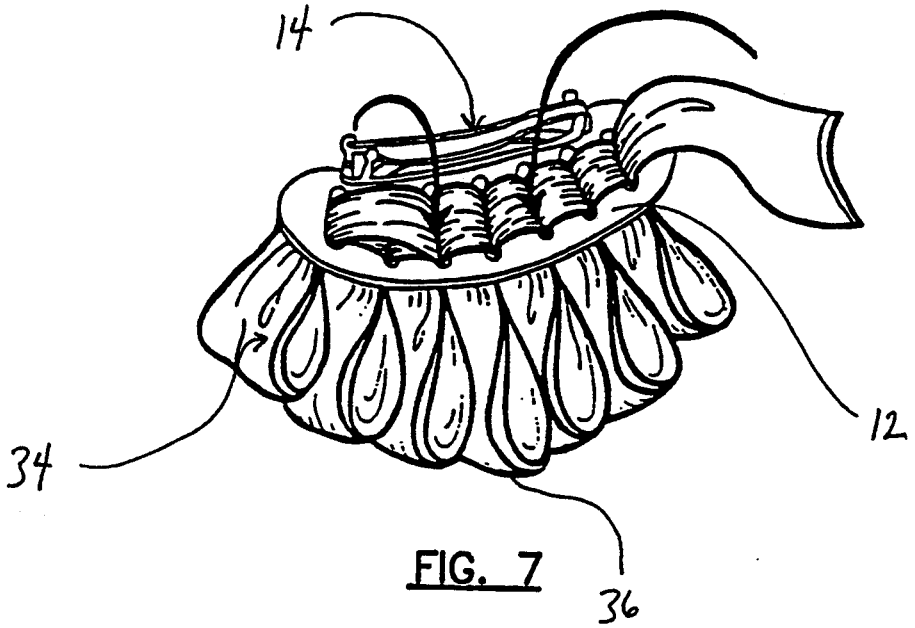
FIG. 7 is a bottom perspective view of the frame showing the almost completed bow with the ends of the strip of fabric being inserted back into respective openings in the frame.

The method of the present invention is best demonstrated in FIGS. 5–7 and 8–12 as including the steps of providing the apparatus as described above and an elongated strip of decorative material which may be a scarf 34 or any other suitable or desired material. FIGS. 5–7 demonstrate the method of the present invention to create the hair bow knows as the "basic poof" the first step of which is to fold the scarf 34 in half to find the center 36. Working from the bottom side of the longitudinally extended plate 12, the center 36 of the scarf 34 is extended through a transverse opening 16 in the plate 12 nearest the center point of the plate 12 to form a loop 38, as shown in FIG. 5. Additional loops are formed by extending portions of the scarf 34 through adjacent openings 16 in the plate 12, as shown in FIG. 6. Finally, when all of the transverse openings 16 have scarf loops extending outwards therefrom, the ends of the scarf 34 may be pushed into respective openings 16 to secure these ends, as shown in FIG. 7, or may be left hanging out for decorative purposes, as shown in FIG 1. It can be thus seen that the method for manufacturing hair bows of the present invention provides a simple and quick method by which a customized hair accessory may be produced. The finalized "basic poof" design is shown in FIG. 1 after each of the loops is spread to shape the bow and cover the plate 12. The bow may then be adjusted as needed.

Figure 8:
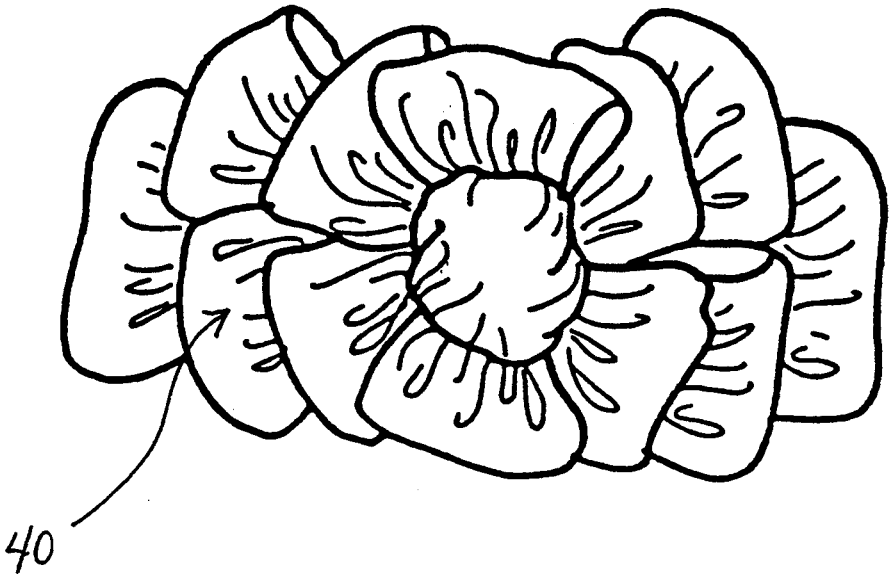
FIG. 8 is a top plan view of an alternative bow which may be produced by the method of the present invention.
Figure 9:
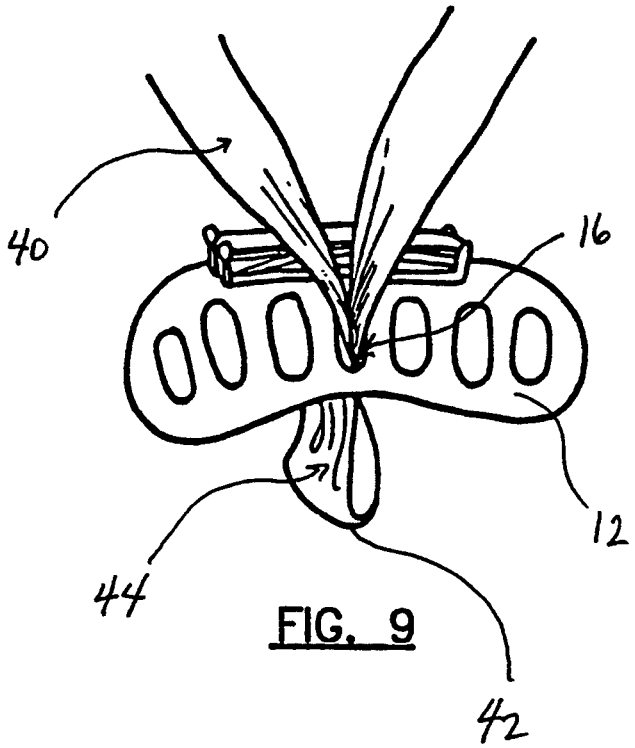
FIGS. 9–12 are bottom perspective views of the frame showing the fabric threading steps for producing the bow of FIG. 8.
Figure 10:
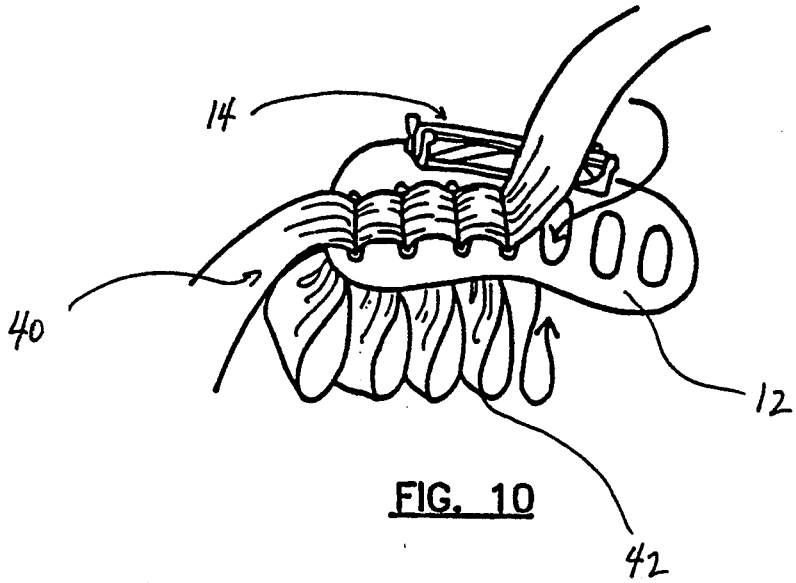
Figure 11:
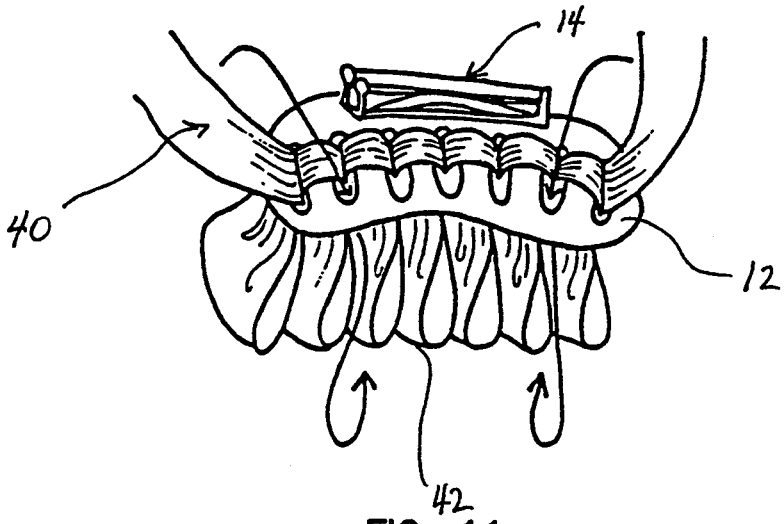
Figure 12:
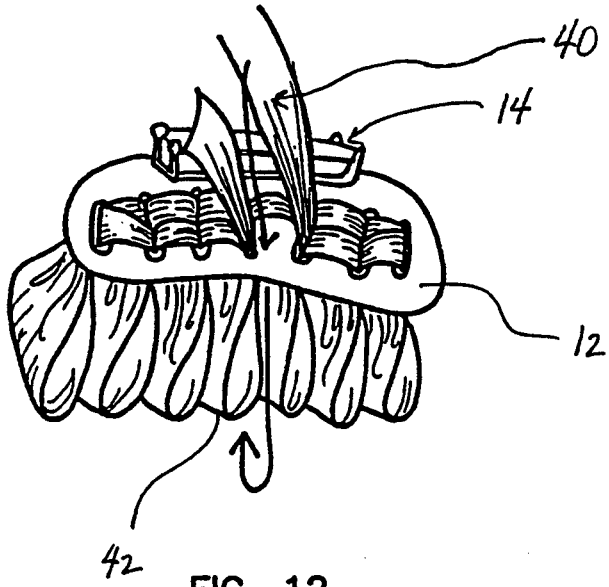

FIGS. 8–12 demonstrate an alternative hair bow type and the method for forming that hair bow type. This particular hair bow type is known as the "rounded poof", the finished version of which is shown in FIG. 8. FIGS. 9–12 demonstrate the method, beginning with FIG. 9 in which a ribbon 40 is provided, the ribbon being folded in half to find the center 42 of the ribbon 40. Again working from the bottom side of the plate 12, extend the center 42 of the ribbon 40 through a transverse opening 16 in the plate 12 nearest the center point of the plate 12. Enough ribbon 40 should be pushed through such that a loop 44 is formed, as shown in FIG. 9. As was previously described in connection with the "basic poof", portions of the ribbon 40 are pushed through adjacent openings 16 to form a plurality of loops extending outwards from each opening 16 on the plate 12. As shown in FIG. 11, this first set of loops is then pushed toward the barrette clip 14 to make room for an additional row of loops. This row of loops starts with the outer ends of the ribbon 40 being looped back through the transverse openings 16 until each opening 16, except for the two endmost openings, has a second loop extending outwards therefrom. The scarf ends are then each secured in one of the transverse openings 16 as shown in FIG. 12. Finally, to form the rounded portion at the center of the bow, the centermost loops are twisted as shown in FIG. 8.

Figure 13:
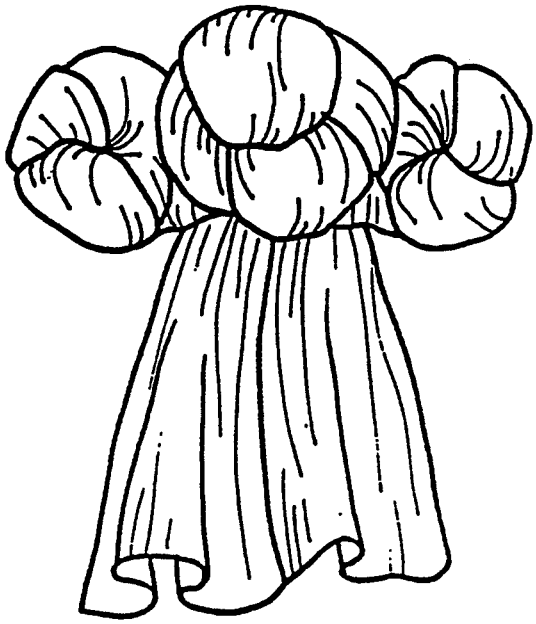
FIGS. 13–15 are top plan views of alternative bows which may be produced by the method of the present invention.
Figure 14:
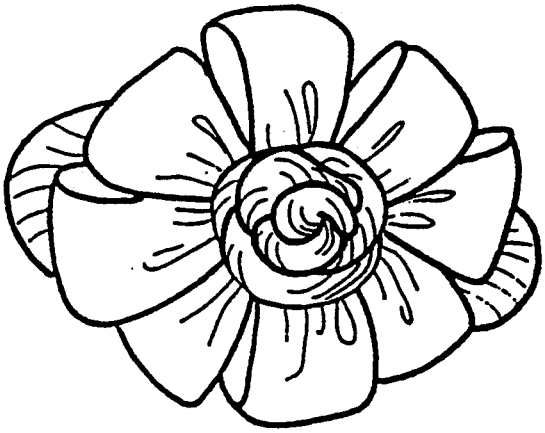
Figure 15:
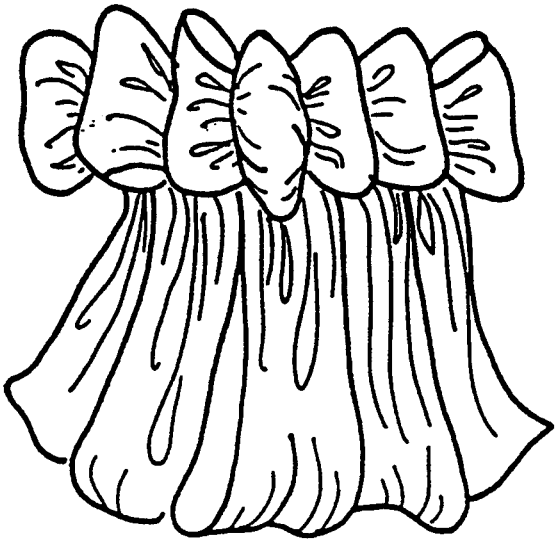

Of course it is to be understood that an almost limitless variety of bow types may be produced with the method of the present invention. For example, some of the various bow types would include a "tri-knot jumbo bow" as shown in FIG. 13 "rosette petals" as shown in FIG. 14 or a "poofed snood" as shown in FIG. 15, each of which may be produced by utilizing a method similar to that described previously in connection with the hair bows disclosed in FIG. 5–7 and 8–12. Additionally, it can be seen from the above description that the method of manufacturing hair bows disclosed by the present invention is far superior to any method or device disclosed in the prior art. The simplicity and rapidity with which this method may produce an almost limitless number of types of hair bows is unmatched by any prior invention. Furthermore, the method of the present invention may be used with a wide variety of decorative materials, including scarves, ribbons or any other elongated strip of fabric. Another advantage of the present invention is that the material used to form the bow may be easily removed and replaced with any other fabric for a bow of a very different look. The fabric used for the bow is not destroyed since it is not sewn, stitched or cut, but rather simply looped through the openings in the plate. This allows a user of the method of the present invention to easily coordinate hair accessories with a number of different outfits without having to purchase a different manufactured bow each time a new outfit is obtained.

There has thus been set forth and described an invention which accomplishes at least all of the stated objectives.

I claim:

1. A method for forming a decorative hair bow, comprising:

providing a longitudinally extended hair bow frame having top and bottom surfaces and a barrette clip mounted on said bottom surface of said frame, said frame including a plurality of openings extending between said top and bottom surfaces;

providing an elongated strip of decorative material having opposite ends;

extending a portion of said strip of decorative material through one of said openings in said frame and folding said portion of said strip back onto itself and back through said one of said openings thereby forming a loop of said decorative material extending out of said one of said openings above said top surface of said frame;

repeating said extending, folding and forming steps of the previous paragraph using another portion of said strip and another one of said openings until a plurality of upwardly extending loops of said decorative material are formed extending from a plurality of said openings;

providing a second elongated strip of decorative material having opposite ends;

extending a portion of said second strip of decorative material through one of said openings in said plate and folding said portion of said second strip back onto itself and back through said one of said openings thereby forming a loop of said decorative material extending out of said one of said openings above said top surface of said plate; and repeating said extending, folding, and forming steps as above using another portion of said second strip and another one of said openings until a plurality of upwardly extending loops of said second strip of said decorative material are formed extending from a plurality of said openings thereby forming a bow-like arrangement of decorative material including two strips of decorative material.

2. The method of claim 1 wherein said step of providing a hair bow frame further comprises providing a hair bow frame including a longitudinally extended, generally resilient, generally oval-shaped plate wherein said openings are transversely extended slots adapted to accept portions of said elongated strip of decorative material.

3. The method of claim 1 wherein said step of providing an elongated strip of decorative material further comprises providing a strip of decorated fabric.

4. The method of claim 1 wherein the extending folding and forming steps of the penultimate paragraph of claim 1 further comprises folding said strip of fabric, extending the folded portion of said strip of fabric through one of said openings in said frame from said bottom surface upwards to said top surface and drawing said folded portion of said strip of fabric upwards such that a loop of fabric is formed.

5. The method of claim 1 wherein said repeating step further comprises forming a plurality of folded portions in said elongated strip of decorative material and extending said folded portions upwards through respective openings in said plate to form a plurality of loops of decorative material, thereby forming a bow-like arrangement of decorative material.

6. The method of claim 1 further comprising the step of securing each end of said strip of decorative material into a selected one of said openings, thereby securing said strip of decorative material on said hair bow frame.

7. The method of claim 1 further comprising forming a knot in at least a selected one of said loops such that a different decorative appearance is formed.

8. An apparatus for forming a decorative hair bow comprising:

a longitudinally extended generally resilient hair bow frame having top and bottom surfaces and a barrette clip removably mounted on said bottom surface of said frame;

a plurality of openings formed in said frame extending between said top and bottom surfaces of said frame;

means for detachably fastening said barrette clip to said longitudinally extended resilient frame whereby said barrette clip may be detached from said frame to avoid interference with training a strip of decorative material through said openings;

said means for detachably fastening said barrette clip to said longitudinally extended frame comprising a pair of attachment posts protruding from one of the said frame and said barrette clip and a pair of spaced apart openings in the other of said frame and said barrette clip for receiving said post and means for releasably securing said post in said holes such that said plate and said barrette clip may be releasably secured to one another; and said longitudinally extended resilient frame being generally longitudinally bowed, said pair of attachment posts mounted on said plate being longitudinally spaced slightly less than the longitudinal spacing of said pair of spaced apart openings on said barrette clip such that upon said bowed plate being flattened, said pair of attachment posts and said pair of spaced apart openings are generally aligned such that said posts fit into and are received by said spaced apart openings.

9. The apparatus of claim 8 further comprising an elongated strip of decorative material having opposite ends.

10. An apparatus for forming a decorative hair bow comprising:

a longitudinally extended hair bow frame having top and bottom surfaces;

a barrette clip for securing said hair bow frame on a section of hair, said barrette clip mounted on said bottom surface of said frame;

a plurality of openings formed in said frame extending between said top and bottom surfaces of said frame;

an elongated strip of decorative material having opposite ends;

said elongated strip of decorative material extended through a plurality of said openings from said bottom surface of said frame upwards to said top surface of said frame and above said top surface of said frame, such that a plurality of loops of decorative material are formed above said top surface of said frame;

each of said loops including top portions, said top portions of each of said loops being substantially spaced from said top surface of said frame;

means for detachably fastening said barrette clip to said longitudinally extended frame whereby said barrette clip may be detached from said frame to avoid interference with training said strip of decorative material through said openings.

11. The apparatus of claim 10 wherein each of said top portions of each of said loops is spaced from said top surface of said frame by at least the distance of the transversed dimension of each of said openings through which each of said loops protrude.

* * * * *